US005366306A

United States Patent [19]

Mizutani et al.

[11] Patent Number: 5,366,306

[45] Date of Patent: Nov. 22, 1994

[54] PRINTER INCLUDING INTEGRAL ONE-PIECE MAIN FRAME

[75] Inventors: Minoru Mizutani; Shyoichi Watanabe, both of Tokyo, Japan

[73] Assignee: Oki Electric Industry Co., Ltd., Tokyo, Japan

[21] Appl. No.: 57,974

[22] Filed: May 6, 1993

Related U.S. Application Data

[63] Continuation-in-part of Ser. No. 972,353, Nov. 5, 1992, abandoned, which is a continuation of Ser. No. 653,228, Feb. 8, 1991, abandoned.

[30] Foreign Application Priority Data

Feb. 14, 1990 [JP] Japan ..... 2-12783

[51] Int. Cl.[5] ..... B41J 29/02

[52] U.S. Cl. ..... 400/694; 400/691; 400/693; 346/145

[58] Field of Search ..... 400/692, 693, 691, 694; 346/145

[56] References Cited

U.S. PATENT DOCUMENTS 4,029,915 6/1977 Ojima .
4,357,060 11/1982 Kuhn .
4,634,304 1/1987 Narushima et al. ..... 400/691
4,723,857 2/1988 Yokoi .
4,732,502 3/1988 Yokoi .
4,802,780 2/1989 Yokoi .
5,074,692 12/1991 Mizutani et al. .
5,209,583 5/1993 Lewis et al. ..... 400/692

FOREIGN PATENT DOCUMENTS 0139245 5/1985 European Pat. Off. .
0280974 9/1988 European Pat. Off. .
2136806 2/1973 Germany .

*Primary Examiner*—Edgar S. Burr
*Assistant Examiner*—John S. Hilten
*Attorney, Agent, or Firm*—Wenderoth, Lind & Ponack

[57] ABSTRACT

A main frame (22) of a printer comprises a horizontal bottom plate (23*e*) and walls (23*a* to 23*d*) to form a box-shaped enclosure defining an inner space (23*f*). At least one of the walls is offset from the respective edge (104*a* to 104*c*) of the bottom plate to form an outer space (106) above the bottom plate (23*e*). A platen (8) and a carriage (10) are positioned in the inner space (23*f*) and fixed to the walls (23*b*, 23*c*) of the main frame (22). A controller board (3) and a power unit (4) are positioned in the outer space (106). An upper cover (13) has a top plate (13*e*) and walls (13*a* to 13*d*). The controller board (3) and the power unit (4) are positioned between the walls (13*a* to 13*d*) of the upper cover (13) and the walls (23*a* the 23*d*) of main frame (23). The main frame (22) is formed by integral molding, and provides rigidity required for holding the platen (8) and the carriage (10), while collision or interference between the platen and the carriage (which move mechanically) and the controller board and the power unit is prevented.

32 Claims, 9 Drawing Sheets

PRINTER INCLUDING INTEGRAL ONE-PIECE MAIN FRAME

CROSS REFERENCE TO RELATED APPLICATION

This application is a continuation-in-part of U.S. patent application Ser. No. 07/972,353 filed Nov. 5, 1992, now abandoned, which in turn is a continuation of U.S. patent application Ser. No. 07/653,228 filed Feb. 8, 1991, now abandoned.

FIELD OF THE INVENTION

This invention relates to a printer, and particularly to a frame structure, including a case, for a printer.

BACKGROUND OF THE INVENTION

FIG. 5 is an exploded perspective drawing showing an example of the configuration of a frame, including a case, of a typical serial printer in the prior art.

As illustrated, a printer lower cover 1 is formed by plastic molding or aluminum diecasting, and its upper surface forms an open, shallow box. A ground plate 2 is positioned to cover the bottom surface of lower cover 1. In addition to acting as an electrical ground, ground plate 2 is used to increase the rigidity of lower cover 1. Mounted on a controller board 3 are circuit components or electrical parts for controlling the operation of the printer. The controller board 3 is superimposed over ground plate 2 and is attached thereto by several screws. A power unit (mainly composed of a transformer) 4 is also attached to ground plate 2 by means of screws or the like. Electrical cord 5 connects the power unit 4 to an external power supply.

A mechanical unit 6 includes those mechanically functioning components performing an actual printing operation. Unit 6 includes a mechanism frame 7, formed by plastic molding or sheet metal processing, to support the overall structure. A cylindrical platen 8 is installed with opposite ends thereof supported by opposite sides of the frame 7, so as to be rotatable. Also provided are a print head 9 having a tip placed in opposition to the platen 8, a carriage 10 on which the print head 9 is mounted and which is capable of spacing movement along the axial direction of platen 8, and a carriage shaft 11 which supports carriage 10, as well as various levers, rollers, guides, and the like. A plurality of connectors 12 connect respective components of mechanical unit 6. By connection to connectors of controller board 3 mounted on lower cover 1, connectors 12 establish an electrical connection to the components of the mechanical unit 6, i.e., the driver for the platen 8, the print head 9, and the carriage 10.

An upper cover 13 is formed, as is lower cover 1, into a box-shape opening downwardly, by plastic molding or aluminum diecasting. Cover 13 is attached so as to cover lower cover 1 and mechanical unit 6 which is attached to the lower cover 1. A platen knob 14 is attached to a platen shaft (not shown) which supports platen 8 of mechanical unit 6 through upper cover 13. By turning platen knob 14, platen 8 can be rotated. The upper cover 13 is provided at a rear, upper portion thereof with a medium ejection outlet 15. Print media on which printing has been conducted are ejected through ejection outlet 15. The upper cover 13 also has a sheet guide 16, which guides the print media after ejection thereof through ejection outlet 15.

To assemble the printer of the above configuration, first, controller board 3 and power unit 4 are attached and fastened, by fastening means such as screws, to the respective attachment locations of ground plate 2, which has been attached to the inner bottom surface of lower cover 1. Next, mechanical unit 6, including frame 7 in which are mounted platen 8 and carriage 10 on which print head 9 is mounted, is placed so as to overlie cover 1 and is also fastened thereto by screws. At this time the connectors 12 are plugged into corresponding connectors of board 3, and thus electrical connection of the components of mechanical unit 6 is obtained. Finally, upper cover 13 is connected from the top so as to cover both frame 7 and lower cover 1 and is fastened by screws at several locations. Assembly of the printer thus is complete.

FIG. 6 is an exploded perspective view showing another prior-art example, the mechanical unit 6 of which is slightly simplified. A difference from the previous example is that a paper chute 18, which guides to the platen the print medium on which printing is to be performed, and the lower cover are formed by integral molding. Note that in this figure the upper cover is omitted.

In FIG. 6, a lower cover 17 is formed by plastic molding or aluminum diecasting. The lower cover is formed by integral molding together with the paper chute 1 which guides a print medium on which printing is to be performed toward platen 8 of the mechanical unit. This eliminates the need to provide the mechanical unit with a paper chute, thereby making the structure simpler, smaller, and lighter. As with the example of FIG. 5, a controller board 3 for controlling and driving the printing operation and a power unit 4 are attached to lower cover 17 by fastening means such as screws. In addition, fastened to the bottom of lower cover 17, with screws as before, is a ground plate 2 to enhance the rigidity of lower cover 17 and to maintain an electrical ground potential.

A mechanical unit 19 has lateral side frames **19*a* and 19*b* which support plate 8, carriage shaft 11 which supports carriage 10 in such a way that carriage 10 is capable of spacing movement with print head 9 being mounted on carriage 10, support shaft 20 which also supports carriage 10**, and the like.

To assemble the printer of the above configuration, first ground plate 2 is attached and fastened, by screws, to the bottom of lower cover 17. After that, controller board 3 and power unit 4 are fastened by screws, at respective locations behind paper chute 18, on lower cover 17. Next, mechanical unit 19 is attached by overlaying it from above in such a way that platen 8 of mechanical unit 19 conforms to paper chute 18 of lower cover 17. Unit 19 also is fastened at several locations by screws. Finally, an upper cover (not shown) is connected so as to cover lower cover 17 and mechanical unit 19. This completes the assembly of the printer.

However, the above described prior-art structures have the following problems.

First, in the example of FIG. 5, the configuration is such that controller board 3, power unit 4, and mechanical unit 6 are positioned over lower cover 1. Thereby, lower cover 1 and mechanical frame 7 form a double structure, and mechanical strength is increased. However, in addition to an increase in complexity due to an increased number of parts, assembly is time consuming since controller board 3 and power unit 4 must be attached to lower cover 1 and ground plate 2, respectively, by screws. Furthermore, electrical connections of controller board 3 and mechanical unit 6 must be made by connecting connectors 12 one by one.

In the other example shown in FIG. 6, mechanical unit 19 supports plate 8, carriage shaft 11, and support shaft 20 only by lateral side frames 19*a* and 19*b*. Therefore, rigidity of the assembly against bending and twisting is insufficient, and the print head gap is inconsistent. A large ground plate sometimes is used for reinforcement, but such arrangement is disadvantageous.

SUMMARY OF THE INVENTION

The invention has been conceived to solve the above problems, and the object of the invention is to provide a printer that is easy to assemble and that has high mechanical strength, with a reduced number of parts and a simplified structure.

In order to fulfill the above purposes, the invention provides a printer comprising:

a main frame (22) comprising a horizontal bottom plate (23*e*) and walls 23*a* to 23*d*) extending upwardly from said bottom plate (23*e*) to define an inner space (23*e*) inside said walls (23*a* to 23*d*) and above said bottom plate (23*e*), and at least one of said walls (23*a* to 23*d*) extending from said bottom plate at a location off an edge of said bottom plate to form an outer space (106*a* to 106*d*) outside said at least one of the walls (23*a* to 23*d*) and above said bottom plate (23*e*);

said main frame (22) being formed of an integral, one-piece structure molded from a plastic material;

a platen (8) and a carriage (10) on which is mounted a print head (9), said platen (8) and said carriage (10) positioned in said inner space and being mounted directly and individually to said main frame (22);

a controller board (3) and a power unit (4) positioned in said outer space (106*a* and 106*d*) and fixed to said main frame (22); and a removable upper cover (13) mounted on said main frame to cover, from above and from sides, said platen (8), said carriage (10), said controller board (3) and said power unit (4).

DETAILED DESCRIPTION OF THE PREFERRED EMBODIMENTS

An embodiment of the invention now will be explained below with reference to FIG. 1 to FIG. 4, FIG. 7A to FIG. 7C, FIG. 8, FIG. 9A, FIG. 9B, FIG. 10A to FIG. 10C and FIG. 11 wherein parts that are identical or similar to those of the prior art are given the same symbols and explanation thereof is omitted.

The printer of this embodiment comprises a main unit 21 and a removable upper cover 13. The main unit 21 includes a main frame 22.

Figure 7A:
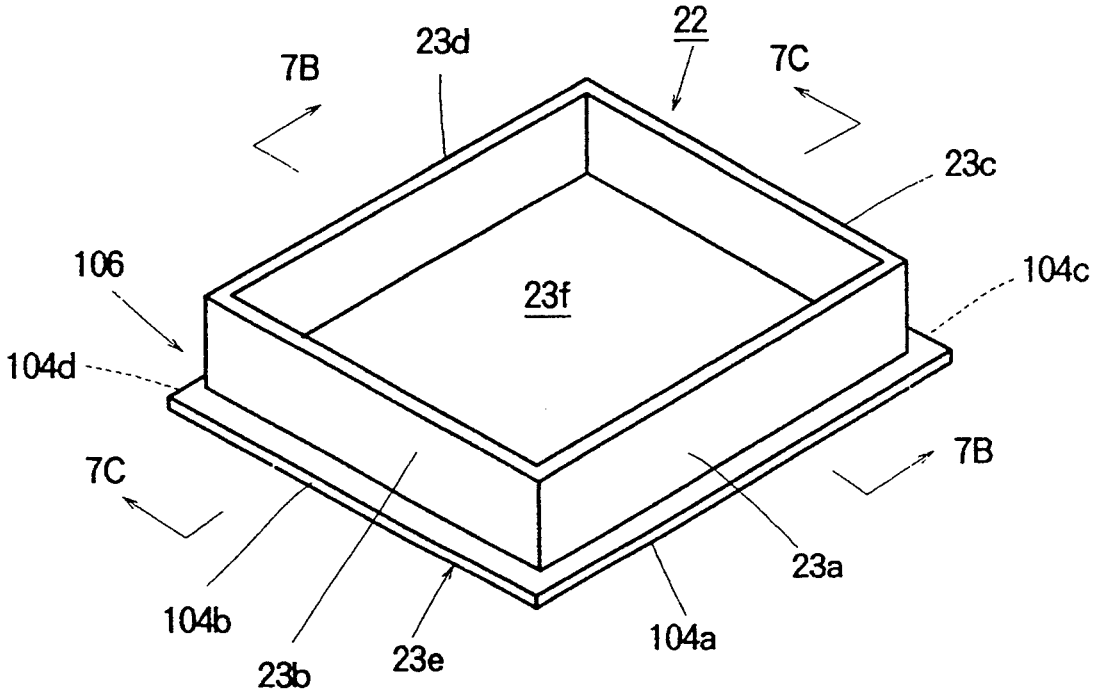
FIG. 7A is a schematic view showing the main frame of FIG. 2, simplifying the illustration and thereby focusing on some of the features of the invention.
Figure 7B:
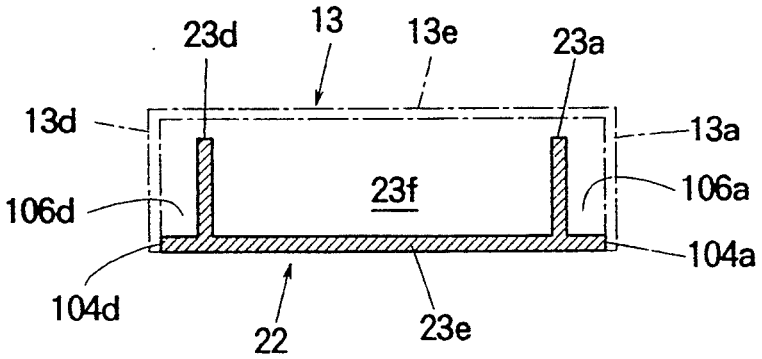
FIG. 7B is a cross sectional view along line 7B—7B in FIG. 7A.
Figure 7C:
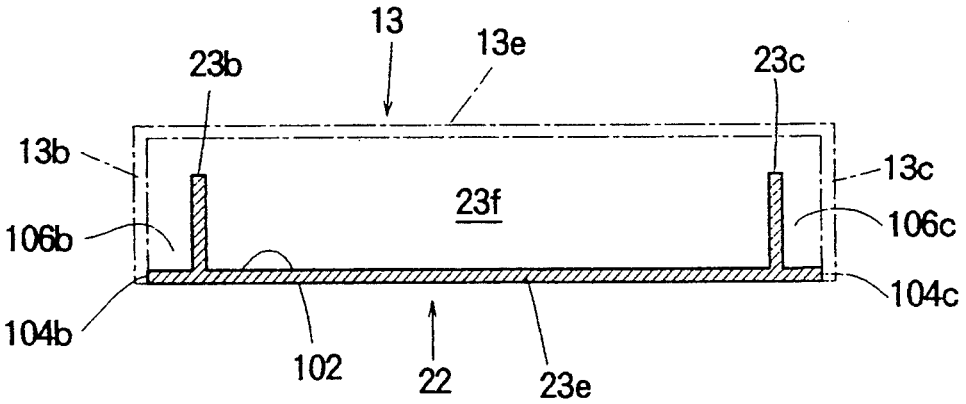
FIG. 7C is a cross sectional view along line 7C—7C in FIG. 7A.
Figure 8:
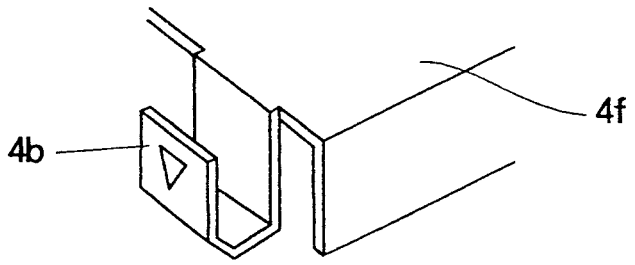
FIG. 8 is a perspective view showing details of a hook of a power unit used in the embodiment of the invention.

FIG. 7A to FIG. 7C are schematic illustrations focusing on certain features of the main frame 22. Upper cover 13 is also shown by dashed lines in FIG.S 7B–7C.

As illustrated, the main frame 22 includes a substantially flat and substantially rectangular, horizontal bottom plate 23*e*, and a front wall 23*a*, side walls 23*b* and 23*c* and a rear wall 23*d*. The walls 23*a* to 23*d* all extend upwardly from vicinities of respective edges of the upper surface 102 of the bottom plate 23*e* to define a rectangular inner space 23*f* inside the walls 23*a* to 23*d* and above the bottom plate 23*e*. The walls 23*a* to 23*d* are interconnected with each other at their edges extending perpendicularly to the bottom plate 23*e*, so that the walls 23*a* to 23*d* and the bottom plate 23*3* together form a box-like structure or enclosure.

The walls 23*a* to 23*d* extend from the bottom plate 23*e* at locations off or spaced inwardly from the edges 104*a* to 104*d* of the bottom plate 23*e*to form an outer space 106 outside the walls 23*a* to 23*d* and above the bottom plate 23*e*. The outer space 106 can be seen as comprising space sections 106*a* to 106*d* respectively formed outside and adjacent the respective walls 23*a* to 23*d* and above the bottom plate 23*e*.

Although in the illustrated embodiment, all the four walls 23*a* to 23*d* are formed off the edges 104*a* to 104*d* of the bottom plate 23*e* to form the outer space 106 all around the walls 23*a* to 23*d*, it is not required that all the four walls are spaced or offset from corresponding edges of the bottom plate 23*e* and it suffices that one or more of the walls 23*a* to 23*d* are offset the edge or edges of the bottom plate 23*e* to form the outer space outside and adjacent one or more of the walls. In such a case,the remainder of the walls 23*a* to 23*d* extend from the corresponding edges of the bottom plate 23*e*.

The main frame 22 comprising the bottom plate 23*e* and the walls 23*a* to 23*d* is formed of an integral, one-piece structure molded from a plastic material, such as ABS resin reinforced with glass fiber, PPO resin reinforced with glass fiber, PC/ABS polymer alloy (polymer blend) resin reinforced with glass fiber, ABS/PBT polymer allow resin reinforced with glass fiber, or the like.

Figure 1:
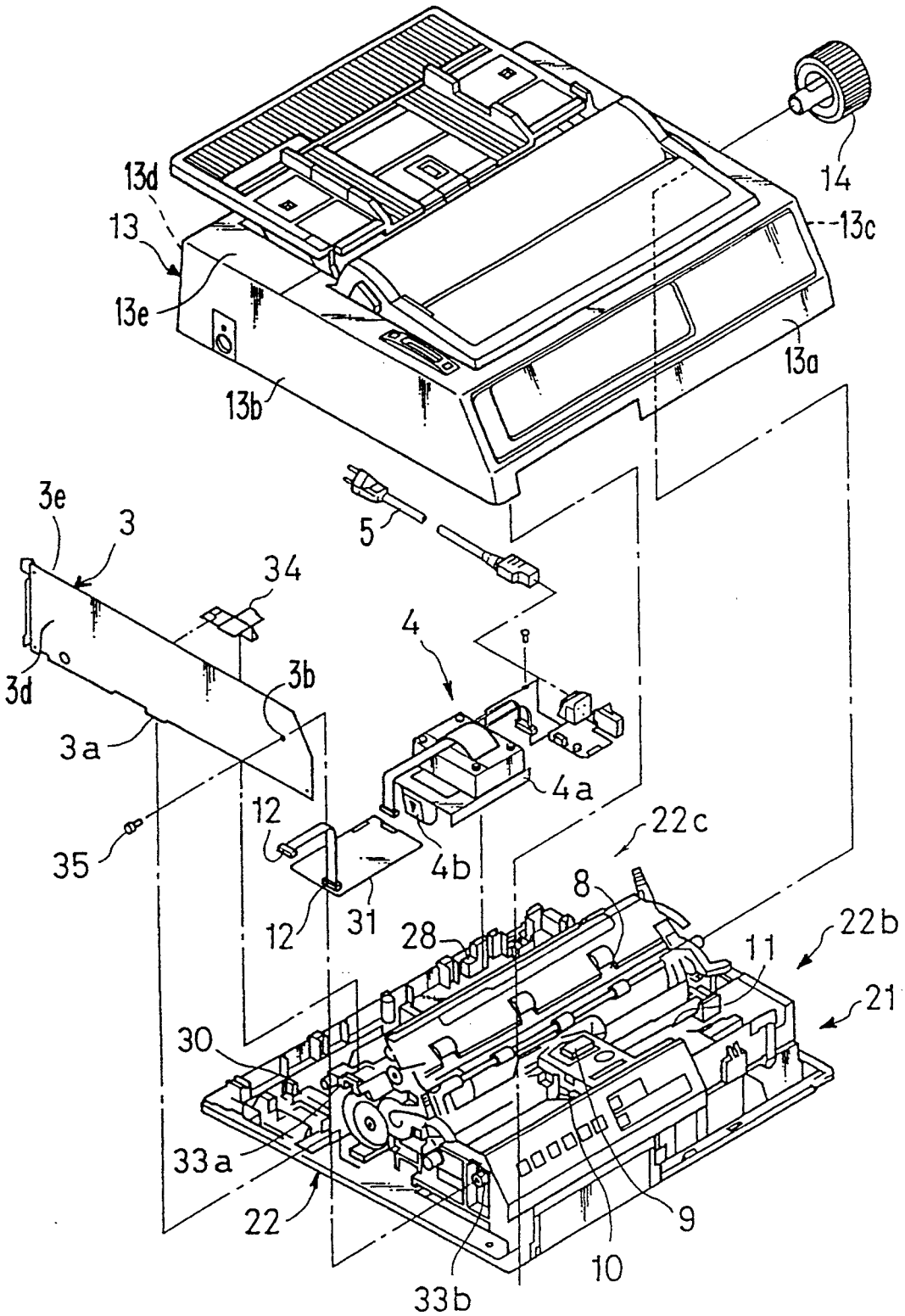
FIG. 1 is an exploded perspective view of a printer according to an embodiment of the invention.
Figure 2:
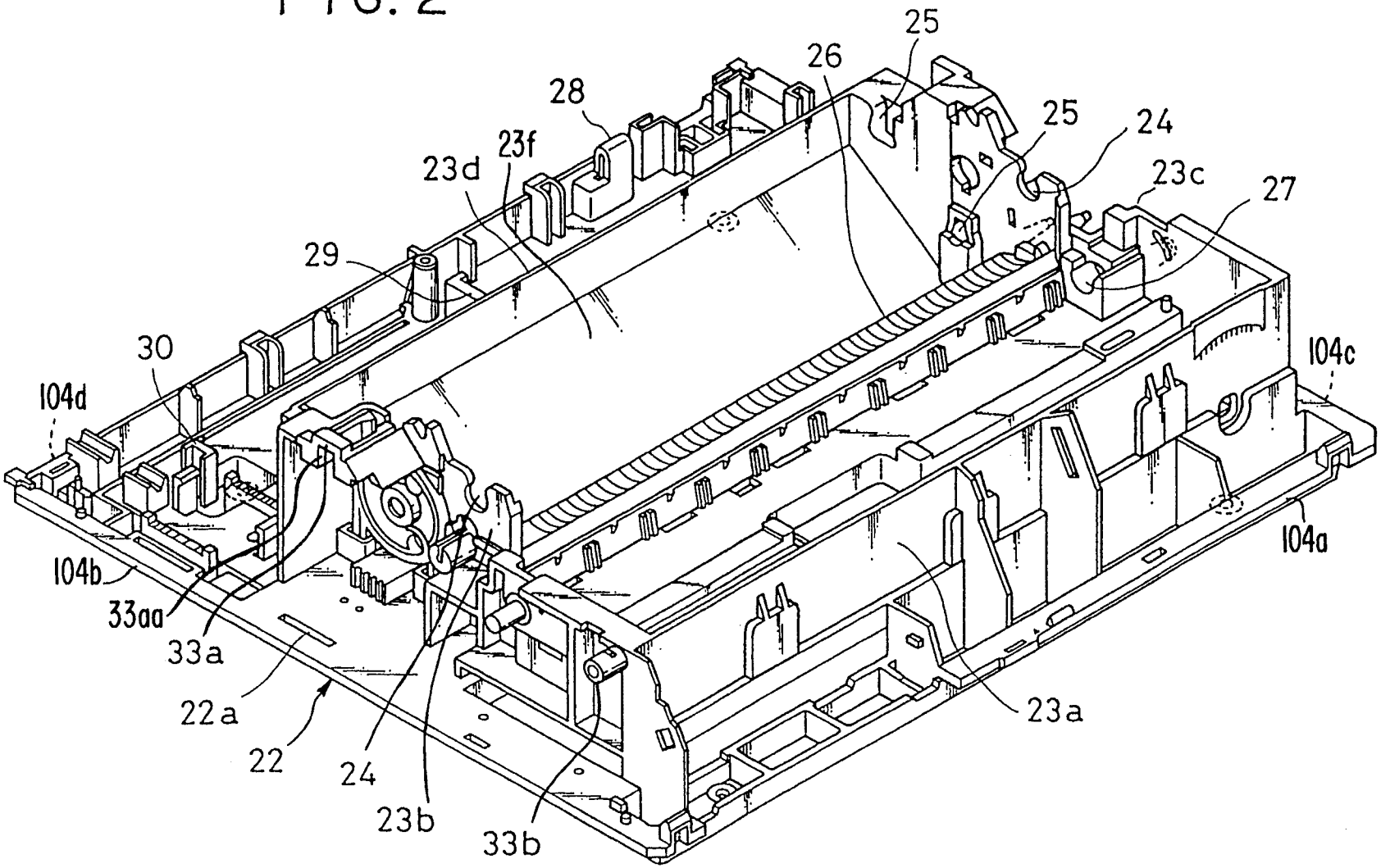
FIG. 2 is an enlarged perspective view of the structure of a main frame shown in FIG. 1.

Mechanical components of the printer, i.e., platen 8, print head 9, carriage 10, carriage shaft 11, a platen drive motor, levers, and the like, are attached and assembled as shown in FIG. 1 at their respective support sections inside and outside the enclosure formed by front wall 23*a*, side walls 23*b* and 23*c*, and rear wall 23*d* of main frame 22 shown in FIG. 2.

Specifically, platen 8 and carriage 10 on which is mounted print head 9 are positioned in the inner space 23*f* and are mounted directly and individually to the side walls 23*b* and 23*c* of the main frame 22. More specifically, a platen support section 24 is formed at each of opposite side walls 23*b* and 23*c* to rotatably support the platen 8 (shown in FIG. 1). Pin tractor support sections 25 formed on side walls 23*b* and 23*c* support a pin tractor (not shown) for feeding a print medium (not shown). A carriage support section 27 is formed on each of the side walls 23*b* and 23*c* for supporting carriage shaft 11 which guides carriage 10.

The platen support sections 24, the pin tractor support sections 25, and the carriage support sections 27 together form a mechanical component attachment section 22*b*. Thus, the platen support sections 24, the pin tractor support sections 25, and the carriage support sections 27 are all formed on the side walls 23*b* and 23*c*. In other words, they are fixed to the side walls 23*b* and 23*c* directly and individually.

A paper guide section 26 guides the print medium to platen 8. Thus, support sections 24, 25, 26 and 27 are all provided on the main frame 22 and fixed to it directly and individually.

The box-like structure formed of the bottom plate 23*e* and the walls 23*a* to 23*d* provides a rigidity required for supporting the mechanical components including the platen 8 and the carriage 10.

A controller board 3 and a power unit 4 are positioned in the outer space 106 and are fixed to the bottom plate 23*e* of the main frame 22. The power unit 4 and the controller board 3 are electrically connected with each other. The controller board 3 is electrically connected with the print head 9, the carriage 10 and the platen 6 for control over thereof. The power unit 4 is positioned in the outer space section 106*d* at a location outside and adjacent the rear wall 23*d*. More specifically, catches 28 are formed on the bottom plate by integral molding with the main frame 22. Likewise, a hold-down 29 is formed by integral molding with the main frame 22 to hold down an end of power unit 4 and to maintain the power unit 4 in position. The catches 28 and the hold-down 29 serve as a structure to which power unit 4 can be attached without the use of screws.

Details of the structure for attachment of power unit 4 are shown in FIG. 3, FIG. 8, FIG. 9A and FIG. 9B. As can be seen therein, projections 4*a* are provided on a first end of a bottom base 4*f* of power unit 4 and a flexible hook 4*b* is provided on a second end of bottom base 4*f* of power unit 4 as means for respective attachment to catches 28 and to hold-down 29. Catches 28 are positioned to engage with projections 4*a* of power unit 4.

Figure 9A:
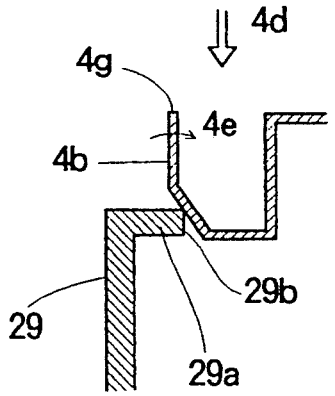
FIG. 9A and FIG. 9B are cross sectional views showing the process of bringing the hook of FIG. 8 into engagement with a hold-down also used in the embodiment of the invention.
Figure 9B:
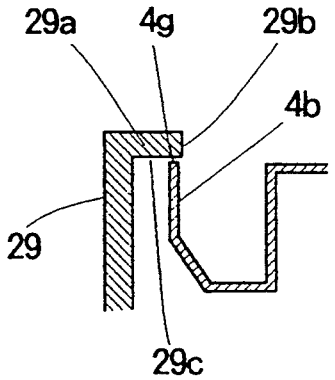

When attaching power unit 4, projections 4*a* of power unit 4 are inserted into grooves 28*a* of catches 28. Then, the second end of power unit 4 is lowered as indicated by an arrow 4*d* in FIG. 9A, whereupon hook 4*b* will contact hold-down 29. The second end of the power unit 4 is further lowered and hook 4*b* will bend back as indicated by an arrow 4*e* in FIG. 9A, and slides against an edge 29*b* of a hook 29*a* of hold-down 29 until the upper edge 4*g* of the hook 4*b* clears the edge 29*b* and slips beneath hook 29*a*, and the upper end 4*g* of hook 4*b* is brought into engagement with a lower surface 29*c* of hook 29*a* as shown in FIG. 9B. Thus, by supporting first end of power unit 4 with catches 28 and second end with hold-down 29, it is possible to attach power unit 4 to a specified position of main frame 22 without the use of separate parts such as screws.

Figure 3:
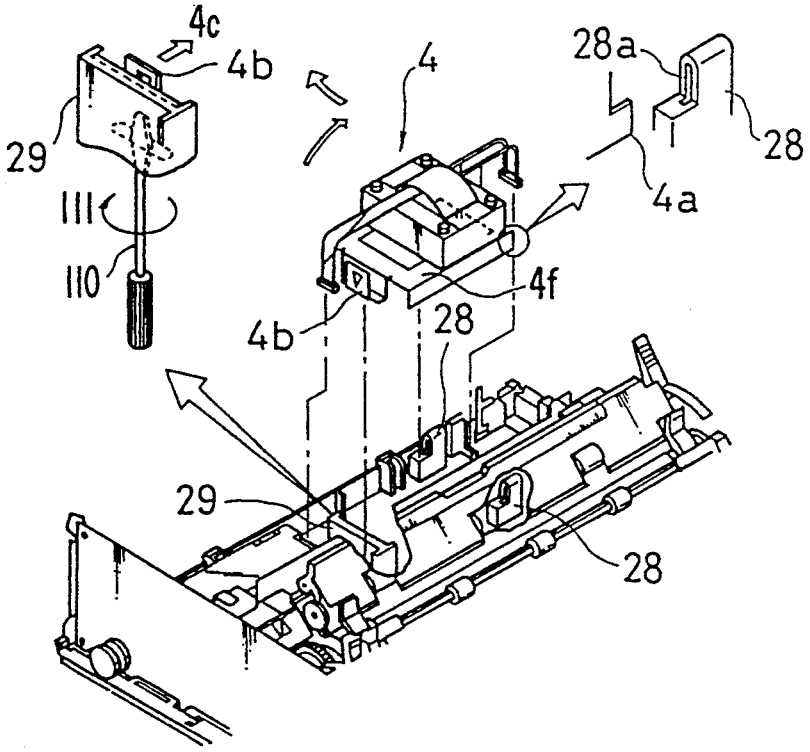
FIG. 3 is an exploded perspective view of a pertinent portion of the main frame, showing how a power unit is attached.

To remove power unit 4, a tool having a strip-shaped end (with a cross section having different dimensions in mutually orthogonal directions) such as a screwdriver 110 is inserted through an aperture provided in the bottom plate 23*e* between the hold-down 29 and the hook 4*b* as shown in FIG. 3, and the hook 4*b* is pushed inwardly as indicated by arrow 4*c*, e.g., by rotating the screwdriver as indicated by arrow 111. As a result, the restraining force acting on hold-down 29 is released. Power unit 4 can thereby be removed from main frame 22.

Figure 4:
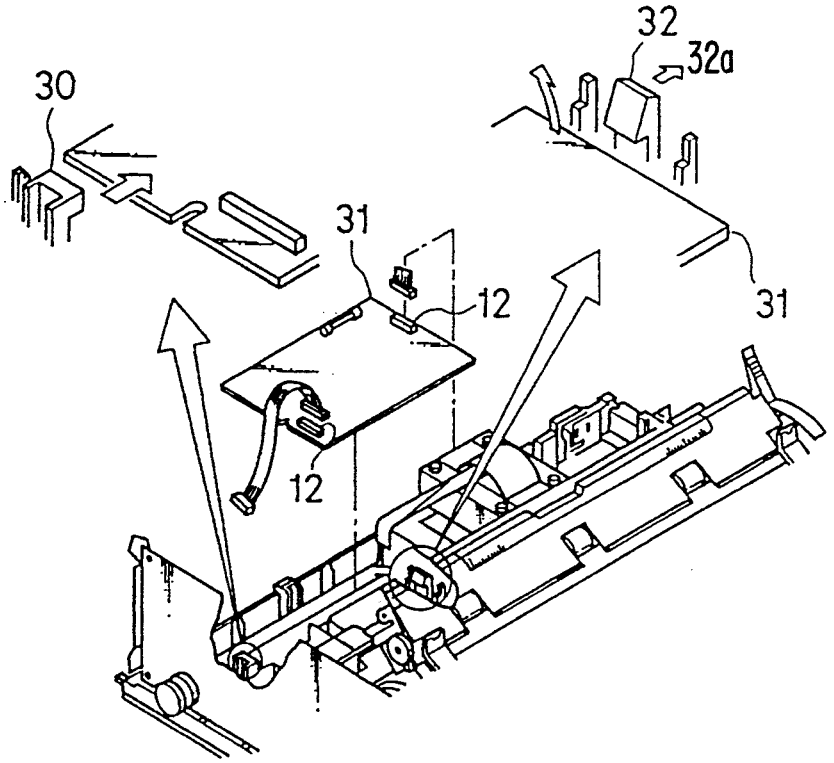
FIG. 4 is an exploded perspective view of a pertinent portion of the main frame, showing how a controller board is attached.
Figure 5:
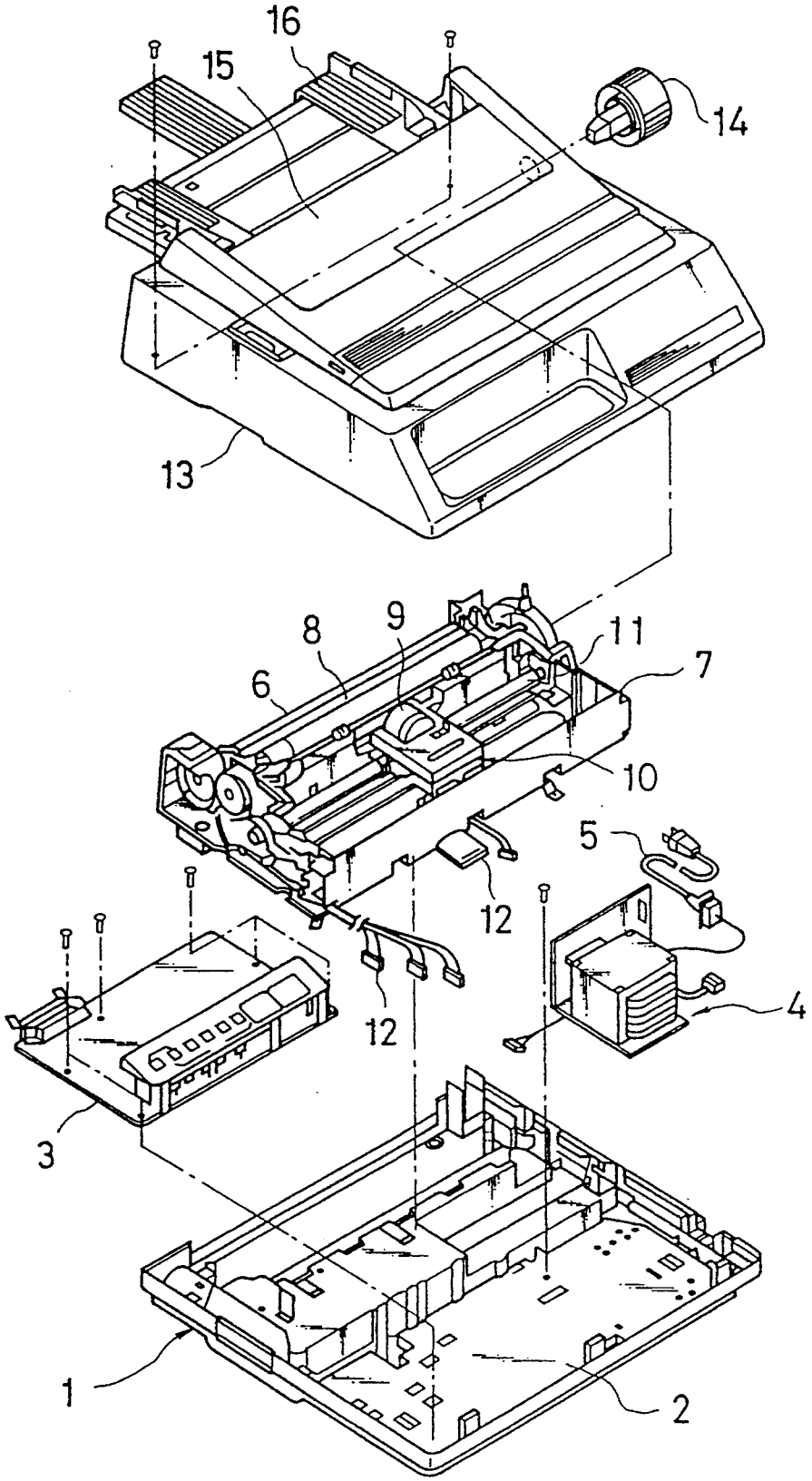
FIG. 5 PRIOR ART
FIG. 5 is an exploded perspective view showing a prior-art printer.
Figure 6:
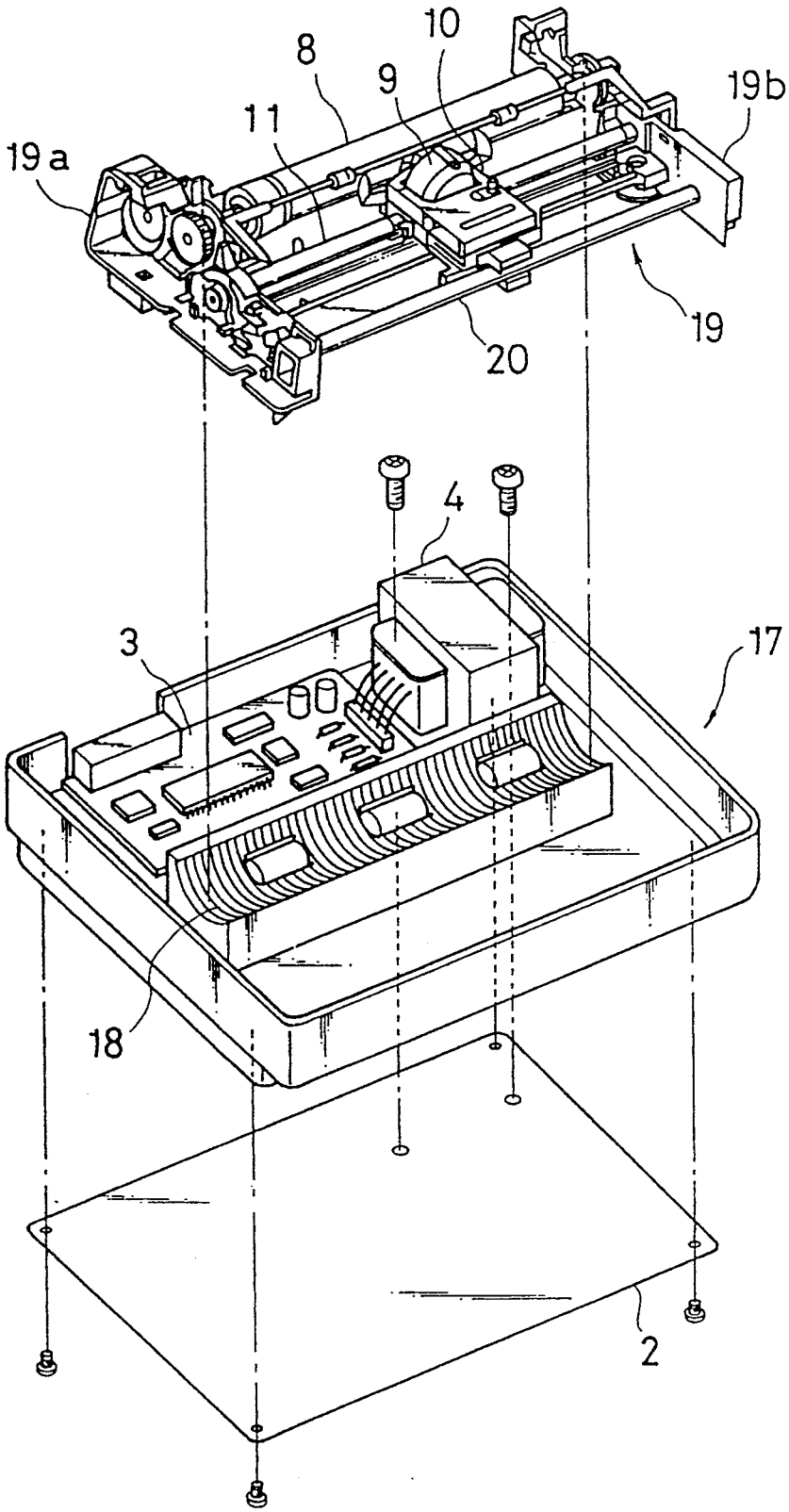
FIG. 6 PRIOR ART
FIG. 6 is an exploded perspective view showing another prior-art printer.

Returning to FIG. 1 and FIG. 2, a support projection 30 is used for attaching a power unit board 31 provided adjacent to the position where power unit 4 is mounted. The structure for attaching the power unit board 31, including support section 30, is shown in FIG. 1 and FIG. 4. Provided on the top surface of power unit board 31 are a connector 12 for connection with power unit 4 and another connector 12 for connection with controller board 3. A snap 32 cooperates with support projection 30 (shown in FIG. 2) to form an attachment structure for power unit board 31. Snap 32 is positioned in opposition to support projection 30 and has a flexible structure. To connect power unit board 31, one end thereof is pushed toward support projection 30 to achieve engagement therebetween, and then, in this condition, the other end of board 31 is lowered and is pushed down against snap 32, so that snap 32 bends backwardly, whereupon power unit board 31 is retained on and attached to main frame 22. To remove power unit board 31, snap 32 is bent backwardly away from power unit board 31 (in the direction of the arrow 32*a* in FIG. 4) to release the locking action of snap 32 with power unit board 31. Power unit board 31 thereby may be removed from main frame 22. Support projection 30 and snap 32 are provided and formed by integral molding with bottom plate 23*e*. As described above, no screws are used to attach power unit board 31.

The controller board 3 is positioned in the outer space section 106*b* at a location outside and adjacent the side wall 23*b*. The controller board 3 is oriented such that its principal plane 3*d* is perpendicular to the upper surface 102 of the bottom plate 23*e*.

Returning again to FIG. 1 and FIG. 2, also formed on main frame 22 are attachment structures for attaching controller board 3. Formed on one side (the left side as seen in FIG. 1 and FIG. 2, of main frame 22 are seats 33*a* and 33*b* for attaching controller board 3. Formed in the bottom plate 23*e* of the main frame 22 is an engagement hole 22*a* that mates with tab 3*a* protruding downwardly from the lower edge of controller board 3. A locking plate 34 functions in cooperation with seat 33*a*, and an attachment pin 35 engages with the other seat 33*b*. Attachment of controller board 3 is achieved first by inserting tab 3*a* into engagement hole 22*a* of main frame 22, thereby mating the two. Afterwards, the upper edge 3*e* of controller board 3 is supported by locking plate 34 engaged with seat 33*a*, and attachment pin 35 is inserted through a hole 3*b* in the controller board 3 and fastened to seat 33*a*. The controller board 3 thereby is attached to main frame 22.

Figure 10A:
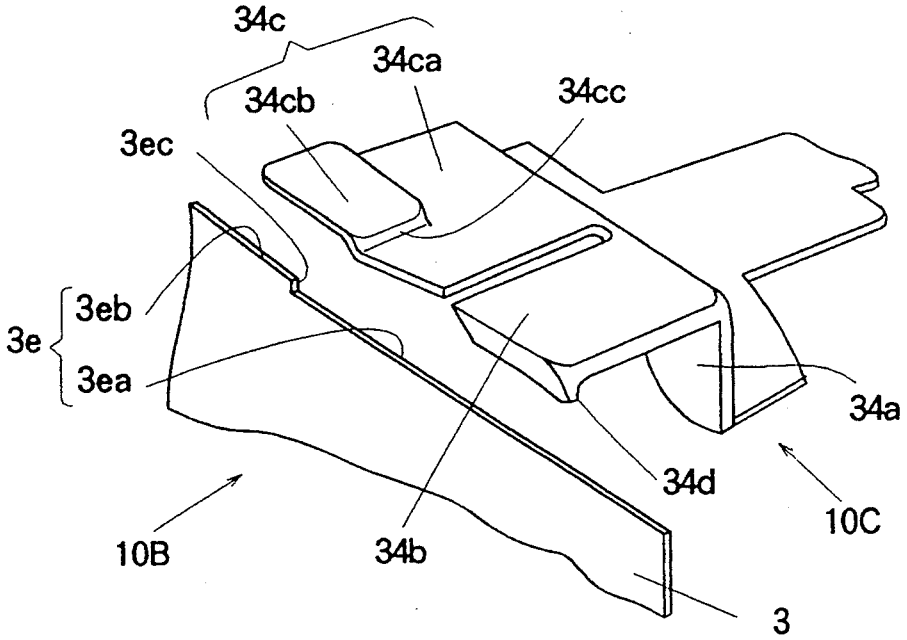
FIG. 10A is a perspective view showing details of a locking plate, together with a controller board, used in the embodiment of the invention.
Figure 10B:
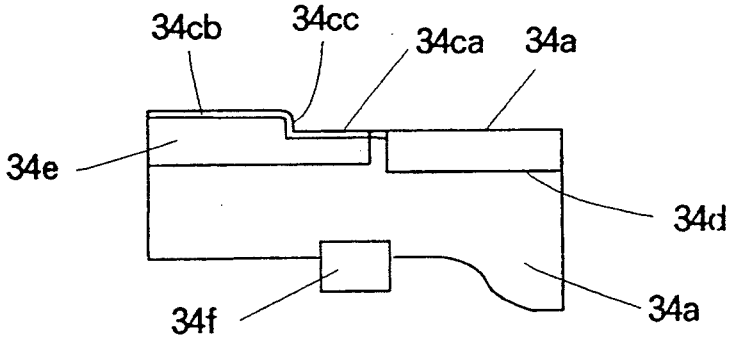
FIG. 10B is a view as seen from the direction 10B in FIG. 10A.
Figure 10C:
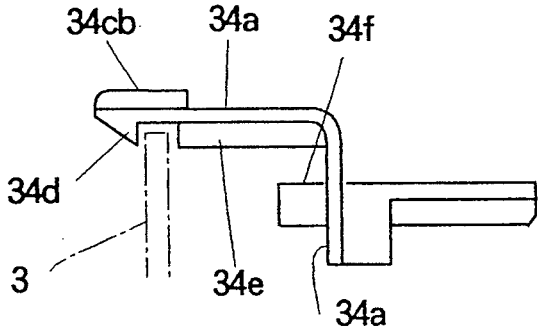
FIG. 10C is a view as seen from the direction 10C in FIG. 10A

FIG. 10A, FIG. 10B and FIG. 10C show details of the locking plate 34. As illustrated, the locking plate 34 comprises an upright part 34*a*, a first horizontal part 34*b* extending from a first part of the upper edge of the upright part 34*a* toward the controller board 3, and a second horizontal part 34*c* extending from a second part the upper edge of the upright part 34*a* toward the controller board 3. The first and second horizontal parts 34*b* and 34*c* are positioned side by side, and the first and second parts of the upper edge of the upright part 34*a* are continuous to and adjacent to each other. A hook 34*d* extending downward is provided at the free end of the first horizontal part 34*b*. A stopper 34*e* is provided on the lower surface of the second horizontal part 34*c*.

The second horizontal part 34*c* comprises a major part 34*ca* and an elevated part 34*cb*, formed at a location farther from the first horizontal part 34*b*. The first and second horizontal parts 34*b* and 34*c* have resilient properties, and can therefore bend in up and down directions.

The locking plate 34 further comprises an engagement part 34*f* extending from a lower part of the upright part 34*a* toward the controller board 3. The first and second horizontal parts 34*b* and 34*c*, as well as other parts of the locking plate 34 are made integrally by molding a plastic material.

In assembly, the engagement part 34*f* is inserted in an opening 33*aa* (FIG. 2) provided in the seat 33*a* by moving locking plate 34 toward controller board 3 (from upper right to lower left as seen in FIG. 1 or FIG. 10A, from right to left as seen in FIG. 10C). The hook 34*d* and the elevated part 34*cb* are made to engage with the upper edge 3*e* of the controller board 3. Specifically, the upper edge 3*e* of the controller board 3 comprises a major part 3*ea* and an elevated part 3*eb*. The major part 3*ea* of the upper edge 3*e* is made to be positioned between the hook 34*d* and the stopper 34*e*, and is resiliently pressed downward by the resilient action of the first horizontal part 34*b*. The upper edge of the controller board 3 is therefore prevented from shifting sideways. When the locking plate 34 is pushed toward the controller board 3, the engagement part 34*f* is inserted in the opening 33*aa* of the seat 33*a*, as described above, and at the same time, by the resilient bending action of the first horizontal part 34*b*, the hook 34*d* rides over the upper edge of the controller board 3, which therefore is positioned between the hook 34*d* and the stopper 34*e*.

The elevated part 3*eb* of the upper edge 3*e* is provided to engage with the elevated part 34*cb* of the second horizontal part 34*c*. The step 3*ec* between the elevated part 3*eb* and the major part 3*ea* of the upper edge 3*e* of the controller board 3 engages with a step 34*cc* between the elevated part 34*cb* and the major part 34*ca* of the second horizontal part 34*c* of the locking plate 34. The upper edge of the controller board 3 is thereby preventing form shifting lengthwise.

Figure 11:
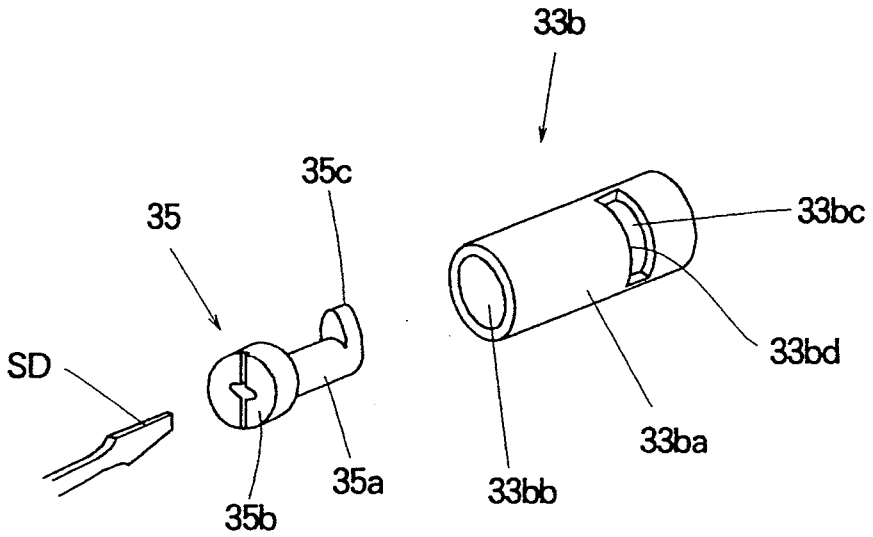
FIG. 11 is a perspective view showing details of an attachment pin, together with a seat, used in the embodiment of the invention.

FIG. 11 shows details of the attachment pin 35. As illustrated, it has a stem part 35*a*, a head 35*b* on a first end of the stem part 35*a*, and a projection 35*c* on a second end of the stem part 35*a*. The stem part 35*a*, the head 35*b* and the projection 35*c* are integrally formed. The projection 35*c* projects sideways from the second end of the stem part 35*a*. The seat 33*b* comprises a tubular part 33*ba*, having a tubular cavity 33*bb* with an elliptical cross section. The tubular part 33*ba* is provided with an opening 33*bc* extending along the periphery of the tubular part 33*ba*. The opening 33*bc* is formed by cutting away part of the tubular wall so that an exposed, cut end 33*bd* serves to engage with the projection 35*c*, as will be later described. The opening 33*bc* extends over an angular area centered around the minor axis of the elliptical cross section of the tubular cavity 33*bb*.

The attachment pin 35 is used to fix the controller board 3 to the seat 33*b*. For such fixing, the attachment pin 35 is inserted through a hole 3*b* in the controller board 3 and into the elliptical cavity 33*bb* of the tubular part 33*b*. For this insertion, the attachment pin 35 is oriented such that the projection 35*c* extends in the direction of the major axis of the elliptical cross section of the cavity 33*bb*. When the attachment pin 35 is fully inserted, the attachment pin 35 is turned, by the use of a screw driver SD for example, by about 90° so that the projection 35*c* extends in the direction of the minor axis of the elliptical cross section. The projection 35*c* then projects through the opening 33*bc* and is engaged with the exposed cut end 33*bd*. By this engagement, the attachment pin 35 is prevented from removal, and the controller board 3 is therefore securely attached.

Catches 28 with a groove 28*a*, hold-down 29, support projection 30, engagement hole 22*a*, snap 32, locking plate 34, and seats 33*a* and 33*b* together form a fastening section 22*c*.

Upper cover 13 is mounted on the main frame 22 to cover, from above and from sides, the platen 8, the carriage 10, the controller board 3 and the power unit 4.

The upper cover 13 has a top plate 13*e* and vertical walls 13*a* to 13*d* extending downwardly from the top plate 13*e* so that the outer space sections 106*a* to 106*d* are defined between the walls 13*a* to 13*d* and the walls 23*a* to 23*d* (as is best seen in FIG. 7B and FIG. 7C), and the controller board 3 and the power unit 4 are positioned between the walls 23*a* to 23*d* of the main frame 22 and the walls 13*a* to 13*d* of the upper cover 13 when the upper cover 13 is closed or mounted. Specifically, the controller board 3 is between the vertical wall 13*b* and the side wall 23*b*, and the power unit board 31 and the power unit 4 are between the vertical wall 13*d* and the rear wall 23*d*. As a result, they are protected from damage due to collision with external objects.

After covering main unit 21 with the upper cover 13 from above, a platen knob 14 is mounted on a platen shaft through wall 13*c* of upper cover 13. This completes assembly of the printer.

As has been described, according to the invention, a main frame includes a horizontal bottom plate and walls extending from the upper surface of the bottom plate and perpendicularly to the horizontal bottom plate to form a box-shaped enclosure defining an inner space. A platen and a carriage are positioned within the inner space and mounted directly and individually to the side walls of the main frame. At least one of the walls is offset from the edge of the bottom plate to form an outer space. A controller board and a power unit are positioned in the outer space and fixed to the main frame. The bottom plate and the walls of the main frame are integrally molded from a plastic material. They therefore provide sufficient rigidity to hold the mechanical components. That is, mechanical strength is high enough to prevent bending and twisting against mechanical load exerted on the platen and the carriage, to minimize errors in the print head gap and to ensure reliable spacing and line-feed movement.

The controller board and the power unit are positioned in the outer space effectively partitioned from the mechanical components by the walls, which also serve as a structure for holding the mechanical components. This avoids collision or interference between the mechanical components and the controller board and power unit. In addition, dangers of obstruction by the conductors which are connected to the controller board and the power unit to the movement of the mechanical components is eliminated or reduced.

The mechanical components including the platen and carriage (with the print head) are directly and individually mounted to the main frame. The number of parts required for mounting is therefore smaller, and assembly is therefore facilitated.

Assembly of the printer is completed by attaching the platen, carriage and any other mechanical components, the controller board and the power unit at the respective positions of the main frame, and attaching an upper cover over the main unit. Assembly of the printer therefore is very easy.

The controller board and the power unit are attached by means of structures formed by molding. No screws are therefore required for mounting controller board and the power unit. Efficiency of assembly is further improved.

What is claimed is:

1. A printer comprising:

a main frame comprising a horizontal bottom plate having four edges and front, rear and side walls extending upwardly from respective said edges or the vicinities of respective said edges of said bottom plate to define an inner space inside said walls and above said bottom plate, at least one of said walls extending from said bottom plate at a location spaced inwardly from the corresponding said edge of said bottom plate to form an outer space outside said at least one of said walls and above said bottom plate;

said main frame being formed of an integral, one-piece structure molded from a plastic material;

a catch and a hold-down formed by integral molding with said bottom plate of said main frame;

a platen and a carriage having a print head mounted thereon, said platen and said carriage being positioned in said inner space and being mounted directly and individually to said main frame;

a controller board and a power unit positioned in said outer space and fixed to said main frame so that said controller board is oriented vertically with respect to said bottom plate and parallel with one of said side walls, said power unit being fixed to said main frame by engagement of a projection of said power unit with said catch and engagement of a flexible hook of said power unit with said hold-down; and a removable upper cover which is mounted on said main frame and extends, when it is closed, to said edges of said bottom plate and which covers, when it is closed, from above and from sides, said plate, said carriage, said controller board and said power unit.

2. A printer as claimed in claim 1, wherein said platen and said carriage are mounted directly and individually to said side walls.

3. A printer as claimed in claim 1, wherein said controller board is electrically connected to said print head, said carriage, and said platen.

4. A printer as claimed in claim 1, wherein said upper cover has a top plate and vertical walls extending downwardly from said top plate, and said controller board and said power unit are positioned between said walls of said main frame and said walls of said upper cover when said upper cover is closed.

5. A printer as claimed in claim 1, wherein said power unit is positioned at a location adjacent to said rear wall, and said controller board is positioned at a location adjacent one of said side walls.

6. A printer as claimed in claim 1, wherein a support projection and a snap are provided and formed by integral molding with said bottom plate, and further comprising a power unit board fixed to said bottom plate by engagement of a first end of said power unit board with said support projection and by engagement of a second end of said power unit board with said snap.

7. A printer as claimed in claim 1, wherein said controller board is fixed to said main frame by engagement of a tab of said controller board with an engagement hole in said bottom plate.

8. A printer as claimed in claim 7, wherein said one side wall has a seat, and said controller board is fixed to said main frame by means of locking plate which has an upright part, an engagement part extending from said upright part and inserted in an opening of said seat, a horizontal part extending from said upright part and a hook extending downward from an end of said horizontal part and engaging with an upper edge of said controller board by resilient bending action of said horizontal part.

9. A printer as claimed in claim 7, wherein said one side walls has a seat, and said controller board has a hole and is fixed to said main frame by means of an attachment pin inserted through said hole of said controller board and said seat.

10. A printer as claimed in claim 1, wherein said main frame is formed, by injection molding, from ABS resin reinforced with glass fiber, PPO resin reinforced with glass fiber, PC/ABS polymer alloy resin reinforced with glass fiber, or ABS/PBT polymer resin reinforced with glass fiber.

11. A method of making a printer comprising the steps of:

forming by injection molding from plastic material a main frame in the form of an integral, one-piece structure including a horizontal bottom plate having four edges and front, rear and side walls extending upwardly from respective said edges or the vicinities of respective said edges of said bottom plate to define an inner space inside said walls and above said bottom plate, with at least one of said walls extending from said bottom plate at a location spaced inwardly from the corresponding said edge of said bottom plate to form an outer space outside said at least one of said walls and above said bottom plate, wherein said plastic material is ABS resin reinforced with glass fiber, PPO resin reinforced with glass fiber, PC/ABS polymer alloy resin reinforced with glass fiber, or ABS/PBT polymer resin reinforced with glass fiber;

positioning a platen and a carriage having a print head mounted thereon in said inner space; mounting said platen and said carriage directly and individually to said main frame;

positioning a controller board and a power unit in said outer space;

fixing said controller board and said power unit to said main frame so that said controller board is oriented vertically with respect to said bottom plate and parallel with one of said side walls; and mounting a removable upper cover on said main frame so that said upper cover extends, when it is closed, to said edges of said bottom plate, and covers when it is closed, from above and from sides, said platen, said carriage, said controller board and said power unit.

12. A method as claimed in claim 11, wherein said step of mounting said platen and said carriage comprises mounting them directly and individually to said side walls.

13. A method as claimed in claim 11, wherein said step of fixing said controller board and said power unit comprises fixing them to said bottom plate.

14. A method as claimed in claim 11, further comprising electrically connecting said controller board to said print head, said carriage, and said platen.

15. A method as claimed in claim 11, wherein said upper cover has a top plate and vertical walls extending downwardly from said top plate so that said controller board and said power unit are positioned between said walls of said main frame and said walls of said upper cover when said upper cover is closed.

16. A method as claimed in claim 11, wherein said step of positioning said controller board and said power unit comprises positioning said power unit at a location adjacent to said rear wall, and positioning said controller board at a location adjacent one of said side walls.

17. A method as claimed in claim 11, wherein said power unit has a projection and a flexible hook, further comprising forming a catch and a hold-down by integral molding with said bottom plate of said main frame, and said step of fixing said controller board and said power unit comprises fixing said power unit to said main frame by engagement of said projection with said catch and engagement of said flexible hook with said hold-down.

18. A method as claimed in claim 17, wherein said engagement of said projection with said catch is achieved by inserting said projection into a groove of said catch at a first end of a bottom base of said power unit, and said engagement of said flexible hook with said hold-down is achieved by lowering a second end of said power unit so that said flexible hook bends back and slides against an edge of a hook of said hold-down to bend back until said flexible hook clears said edge of said hook of said hold-down, whereupon an upper end of said flexible hook is brought into engagement with a lower surface of said hook of said hold-down.

19. A method as claimed in claim 11, comprising forming a support projection and a snap by integral molding with said bottom plate, and further comprising the step of fixing a power unit board to said bottom plate by engaging a first end of said power unit board with said support projection and engaging a second end of said power unit board with said snap.

20. A method as claimed in claim 19, wherein said engaging said first end of said power unit board with said support projection is achieved by pushing said first end of said power unit board toward said support projection, and said engaging of said second end of sad power unit board with said snap is achieved by lowering said second end of said power unit board to bend said snap backwardly.

21. A method as claimed in claim 11, wherein said controller board has a tab and an engagement hole is provided in said bottom plate, and said step of fixing said controller board and said power unit comprises fixing said controller board to said main frame by engagement of said tab with said engagement hole.

22. A method as claimed in claim 21, wherein a seat is provided on said one side wall, and said step of fixing said controller board and said power unit further comprises fixing said controller board to said main frame by means of a locking plate which has an upright part, an engagement part extending from said upright part and inserted into an opening of said seat, a horizontal part extending from said upright part, and a hook extending downwardly from an end of said horizontal part, and engaging an upper edge of said controller board with said hook by resilient bending action of said horizontal part.

23. A method as claimed in claim 21, wherein a seat is provided on said one side wall, said controller board has a hole, and said step of fixing said controller board and said power unit further comprises fixing said controller board to said main frame by means of an attachment pin inserted through said hole of said controller board and said seat.

24. A printer comprising:

a main frame comprising a horizontal bottom plate having four edges and front, rear and side walls extending upwardly from respective said edges or the vicinities of respective said edges of said bottom plate to define an inner space inside said walls and above said bottom plate, at least one of said walls extending from said bottom plate at a location spaced inwardly from the corresponding said edge of said bottom plate to form an outer space outside said at lest one of said walls and above said bottom plate;

said main frame being formed of an integral, one-piece structure molded from a plastic material;

a platen and a carriage having a print head mounted thereon, said platen and said carriage being positioned in said inner space and being mounted directly and individually to said main frame;

a controller board and a power unit positioned in said outer space and fixed to said main frame so that said controller board is oriented vertically with respect to said bottom plate and parallel with one of said side walls, said controller board being fixed to said main frame by engagement of a tab of said controller board with an engagement hole in said bottom plate; and a removable upper cover which is mounted on said main frame and extends, when it is closed, to said edges of said bottom plate and which covers, when it is closed, from above and from sides, said plate, said carriage, said controller board and said power unit.

25. A printed as claimed in claim 24, wherein said platen and said carriage are mounted directly and individually to said side walls.

26. A printed as claimed in claim 24, wherein said controller board is electrically connected to said print head, said carriage, and said platen.

27. A printer as claimed in claim 24, wherein said upper cover has a top plate and vertical walls extending downwardly from said top plate, and said controller board and said power unit are positioned between said walls of said main frame and said walls of said upper cover when said upper cover is closed.

28. A printer as claimed in claim 24, wherein said power unit is positioned at a location adjacent to said rear wall, and said controller board is positioned at a location adjacent one of said side walls.

29. A printer as claimed in claim 24, wherein a support projection and a snap are provided and formed by integral molding with said bottom plate, and further comprising a power unit board fixed to said bottom plate by engagement of a first end of said power unit board with said support projection and by engagement of a second end of said power unit board with said snap.

30. A printer as claimed in claim 24, wherein said one side wall has a seat, and said controller board is fixed to said main frame by means of locking plate which has an upright part, an engagement part extending from said upright part and inserted in an opening of said seat, a horizontal part extending from said upright part and a hook extending downward from an end of said horizontal part and engaging with an upper edge of said controller board by resilient bending action of said horizontal part.

31. A printer as claimed in claim 24, wherein said one side wall has a seat, and said controller board has a hole and is fixed to said main frame by means of an attachment pin inserted through said hole of said controller board and said seat.

32. A printer as claimed in claim 24, wherein said main frame is formed, by injection molding, from ABS resin reinforced with glass fiber, PPO resin reinforced with glass fiber, PC/ABS polymer alloy resin reinforced with glass fiber, or ABS/PBT polymer resin reinforced with glass fiber.

* * * * *